US011326414B1

(12) United States Patent
Wesson

(10) Patent No.: US 11,326,414 B1
(45) Date of Patent: May 10, 2022

(54) HYDRAULIC JAR AND TRIGGER DEVICE

(71) Applicant: Osado Innovations, LLC, Oklahoma City, OK (US)

(72) Inventor: Shea Keller Wesson, Norman, OK (US)

(73) Assignee: Osado Innovations LLC, Oklahoma City, OK (US)

( * ) Notice: Subject to any disclaimer, the term of this patent is extended or adjusted under 35 U.S.C. 154(b) by 26 days.

(21) Appl. No.: 16/520,942

(22) Filed: Jul. 24, 2019

(51) Int. Cl.
*E21B 31/113* (2006.01)
*E21B 34/06* (2006.01)

(52) U.S. Cl.
CPC ..... *E21B 31/1135* (2013.01); *E21B 34/06* (2013.01)

(58) Field of Classification Search
CPC ..... E21B 31/1135; E21B 34/06
See application file for complete search history.

(56) References Cited

U.S. PATENT DOCUMENTS 3,777,819 A * 12/1973 Delano ..... E21B 19/00 166/285
4,109,736 A 8/1978 Webb et al.
4,456,081 A 6/1984 Newman
5,123,493 A 6/1992 Wenzel
5,503,228 A 4/1996 Anderson
5,595,253 A * 1/1997 Martin ..... E21B 31/1135 166/178
5,647,446 A 7/1997 Wenzel
5,775,423 A 7/1998 Kaczynski
7,011,156 B2 3/2006 von Gynz-Rekowski
7,814,995 B2 10/2010 Clausen
8,936,076 B2 * 1/2015 Xu ..... E21B 31/005 166/178
9,587,453 B2 3/2017 Wesson

* cited by examiner

*Primary Examiner* — Cathleen R Hutchins
*Assistant Examiner* — Ronald R Runyan
(74) *Attorney, Agent, or Firm* — Bruce P. LaBrie; Resolution Legal Group

(57) ABSTRACT

A hydraulic jar includes a tubular housing having central bore and an exterior. The housing includes a passage from the central bore to the exterior. A mandrel is axially movable within the housing, forming an annular space between the mandrel and the housing that includes a timing fluid. The mandrel includes an interior axial space that permits the flow of a drilling fluid. A timing device is fixed to the mandrel in the annular space. A trigger is capable of blocking the flow of drilling fluid through the axial space in the mandrel, and the mandrel moves axially in the housing when the trigger engages the mandrel. The timing device causes the mandrel to move at a first speed and at a second speed to create the impulse. The drilling fluid exits the central bore through the opening after the mandrel moves past the opening.

16 Claims, 3 Drawing Sheets

HYDRAULIC JAR AND TRIGGER DEVICE

BACKGROUND

The present invention pertains to a hydraulic jar, and in particular, but without limitation, to a trigger device usable in a hydraulic jar.

A hydraulic jar is a mechanical tool employed in downhole applications to dislodge drilling or production equipment that has become stuck within a wellbore. Typically, the hydraulic jar is positioned in the drill string as part of the bottom hole assembly (BHA) and remains in place throughout the drilling operations.

A hydraulic jar provides a jarring impact force to free the drill bit or other part of the drill string that may become stuck during a drilling operation. A drilling jar generally consists of a first tubular member, typically referred to as a housing, which telescopically receives a second tubular member, typically referred to as a mandrel. The second tubular member is capable of limited axial movement within the first tubular member, referred to as a stroke. The first tubular member has an impact surface referred to as an anvil. The second tubular member has an impact surface referred to as a hammer. At the end of each stroke, the hammer and anvil are brought into a sudden and/or forceful contact to free the stuck drill string.

A typical hydraulic jar includes the mandrel that is movable within the housing and includes a central bore. During drilling operations drilling mud is delivered through the central bore to the drill bit. The upper end of the mandrel is coupled to the drill pipe, while the lower end of mandrel moves axially in the housing. The lower end of housing is coupled to the remaining components of the BHA. A sealed annular chamber, containing hydraulic fluid, is disposed between the mandrel and the housing. A flow restrictor is disposed within the chamber and coupled to the mandrel, separating the chamber into an upper chamber and a lower chamber. A hammer is coupled to the mandrel between the upper and lower shoulders, i.e., the upper and lower anvils, of the housing.

If a portion of the drill string becomes stuck within the wellbore, either a tension or compression load is applied to the drill string and the hydraulic jar is then fired to deliver an impact blow intended to dislodge the stuck portion or component. For example, when a component becomes stuck below the hydraulic jar, a tension load may be applied to the drill string, causing the drill string and mandrel of the hydraulic jar to be lifted relative to housing of hydraulic jar and the remainder of the BHA, which remains fixed. As the mandrel, with a flow restrictor coupled thereto, translates upward, fluid pressure in the upper chamber increases, and the hydraulic fluid begins to slowly flow from the upper chamber, through the restrictor, to the lower chamber. The increased fluid pressure of the upper chamber provides resistance to the applied tension load, causing the drill string to stretch and store energy, an action typically referred to as cocking. When a predetermined tension load is reached, the hydraulic jar is fired to deliver an impact blow. This is accomplished by releasing the tension load being applied to the drill string and allowing the stored energy of the stretched drill string to accelerate the mandrel rapidly upward within the housing until the hammer of the mandrel impacts the shoulder of the housing. The momentum of this impact is transferred through the housing and other components of the BHA to dislodge the stuck component.

Drilling jars commonly use hydraulic release mechanisms, which can be of varying designs, but usually have a primary fluid passage, which is obstructed by a flow control device positioned in a restrictive bore. The valve configuration prevents the free movement of the hammer portion until such time as the flow control device moves out of the restrictive bore. In order to effect movement of the device, hydraulic fluid slowly bleeds through a fluid bypass creating a time delay until the valve clears the primary fluid passage allowing free movement of the hammer portion of the tool. When the restrictive bore is no longer obstructed by the flow control device, the hammer can telescope unimpeded to create the desired impact.

Other types of jars are fired by dropping phenolic balls or other trigger device into the wellbore. When the trigger device reaches the firing mechanism of the hydraulic jar, the device is activated to deliver the impact blow. This method is often imprecise, and retrieval of the trigger device is difficult.

Hydraulic jars may be bi-directional, meaning they are capable of delivering an impact blow in both the uphole and downhole directions. Alternatively, a hydraulic jar may be uni-directional, meaning it is designed for and is capable of delivering an impact blow in either the uphole or downhole direction, but not both. One problem with the prior art hydraulic drilling jars pertains to the arrangement of moving parts, which provide an orifice to restrict the flow of hydraulic fluid during the cocking action of the hydraulic jar. More specifically, it is difficult to jar in both directions using a single flow control valve, due to problems in getting the valve to center itself properly in the restriction. For that reason, most two way hydraulic jars use two hydraulic flow control valves, one of which is inverted. These bi-directional hydraulic jars have two separate triggering mechanisms, which artificially lengthen the tool and result in an unnecessarily complex valve device.

Other known types of hydraulic drilling jars rely on predetermined clearances between many relatively moving parts to control the flow of hydraulic fluid between the upper and lower chambers. These moving parts often require tight manufacturing tolerances, which are subject to frequent failure due to contamination and malfunction from wear. The problems associated with prior art drilling jars creates problems, particularly in jars that are employed in deep hole drilling, where the reliability and operating characteristics of a downhole tool must be given special consideration as maintenance and repairs are time consuming and costly.

Therefore, there is a need for a flow control valve or a flow control device that is mechanically uncomplicated, is capable of intermittent or continuous use without malfunction, is relatively compact, and has both uni-directional and bi-directional capability. There is also a need for a flow control valve or a flow control device capable of withstanding the pressure and temperature conditions of a deep well operating environment that is easily serviced and repaired. There is also a need for a trigger device that is dependable and readily retrievable. There is also a need for a hydraulic jar that quickly recocks for additional jarring operations. Embodiments usable within the scope of the present disclosure meet these needs.

BRIEF SUMMARY

The present disclosure is directed to a hydraulic jar for creating an impulse force in a downhole string in a wellbore. In one embodiment, the hydraulic jar includes a tubular housing having central bore and an exterior. The housing includes a passage from the central bore to the exterior. A mandrel is axially movable within the housing, forming an annular space between the mandrel and the housing that includes a timing fluid. The mandrel includes an interior axial space that permits the flow of a drilling fluid. A timing device is fixed to the mandrel in the annular space. A trigger is capable of blocking the flow of drilling fluid through the axial space in the mandrel, and the mandrel moves axially in the housing when the trigger engages the mandrel. The timing device causes the mandrel to move at a first speed and at a second speed to create the impulse. The drilling fluid exits the central bore through the opening after the mandrel moves past the opening. In an alternate embodiment, the hydraulic jar includes a recocking device that moves the mandrel toward the opening. In another alternate embodiment, the trigger is attached to a tether that extends into the wellbore. In still another alternate embodiment, a recocking device moves the mandrel toward the opening and provides an impulse force. In yet another embodiment, the interior axial space of the mandrel includes a tapered end that receives the trigger.

In another embodiment, the present disclosure is directed to a hydraulic jar that includes a tubular housing having an interior, an exterior, an anvil, and an opening that extends from the interior to the exterior. A tubular mandrel is included in the interior of the tubular housing and has an interior, an axial opening in the interior, a hammer, and a timing device affixed to the exterior of the mandrel. The tubular mandrel is movable in an axial direction in the housing and drilling fluid flows through the axial opening. A triggering device is attached to a tether that impedes the flow of the drilling fluid through the axial opening. The timing device causes the mandrel to move at a first speed and a second speed and the hammer impacts the anvil. The drilling fluid exits the housing through the opening in the housing after the hammer impacts the anvil. In an alternate embodiment, the hydraulic jar includes a recocking device between the mandrel and the housing that imparts a force on the mandrel that moves the mandrel toward the opening after the fluid exits the housing. In another alternate embodiment, the axial opening includes a tapered end that receives the triggering device.

The present disclosure is also directed to another embodiment of a hydraulic jar the includes a tubular housing having an exterior, a hollow interior, and a passage from the hollow interior to the exterior. A tubular mandrel in the hollow interior forms a timing chamber and a recocking chamber between the mandrel and the housing and the mandrel has an axial bore for the flow of drilling fluid. A timing device in the timing chamber is affixed to the mandrel between the mandrel and the housing. A recocking device in the recocking chamber imparts a force on the mandrel toward the passage in the housing. A triggering device impedes the flow of drilling fluid into the axial bore. The timing device causes the mandrel to move at a first speed and a second speed. The drilling fluid exits the passage to the exterior of the housing after the mandrel moves at the second speed. The recocking device moves the mandrel toward the triggering device. In an alternate embodiment, a tether is attached to the triggering device. In still another embodiment, the axial bore of the mandrel includes a tapered end that receives the triggering device.

The information herein is intended to provide a general description of the invention, and is not intended to fully define nor limit the invention. The invention will be more fully understood by study of the following description and drawings.

BRIEF DESCRIPTION OF THE DRAWINGS

In the detailed description, the following drawings provide various embodiments.

DETAILED DESCRIPTION OF THE INVENTION

The following disclosure provides various embodiments of the present invention. Those skilled in the applicable art will understand that various changes in the design, organization, operation and use of mechanical equivalents may be made within the spirit of the invention.

Figure 1:
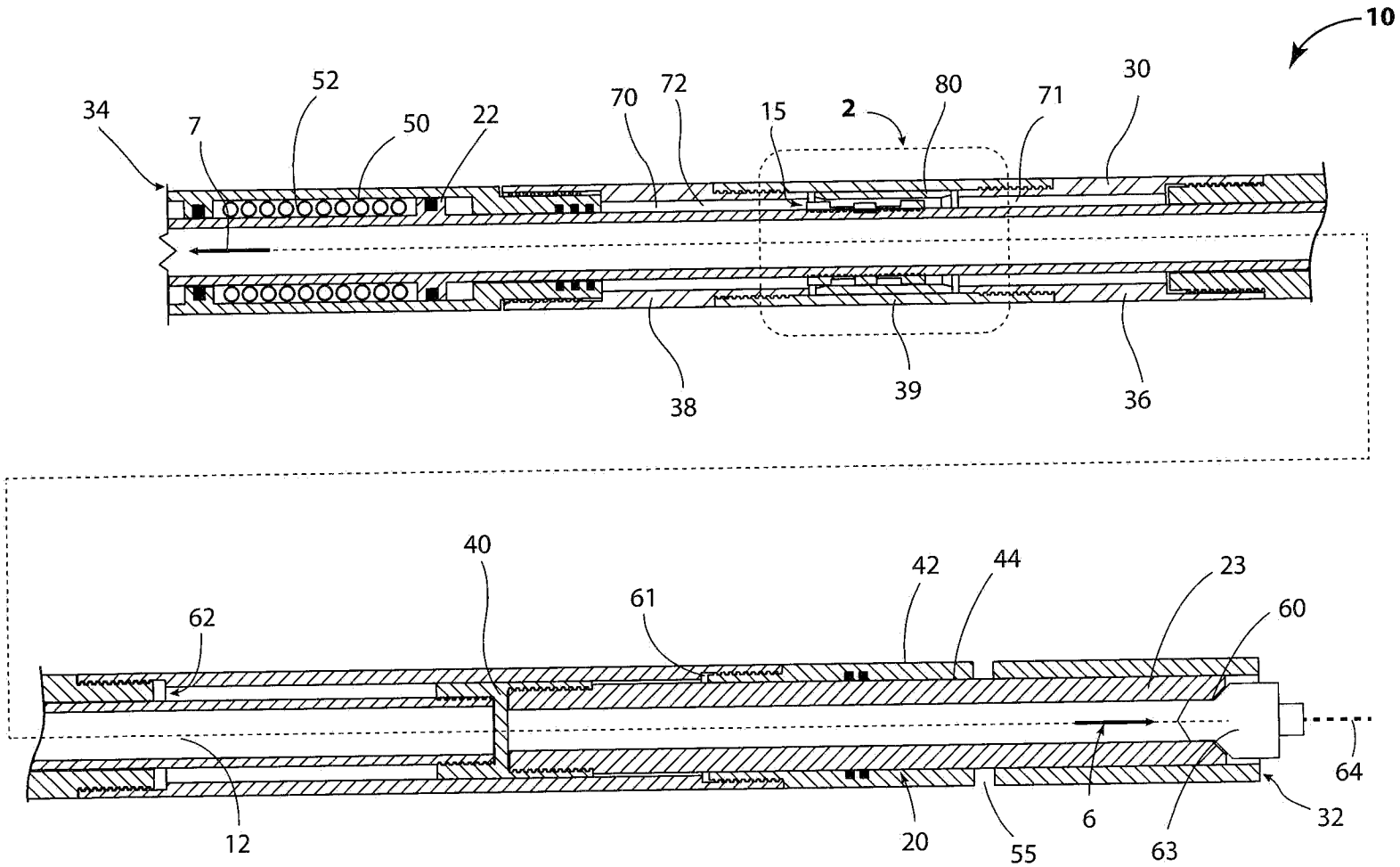
FIG. 1 shows a cross-sectional view of a hydraulic jar in accordance with the present invention.

Referring to FIG. 1, a hydraulic jar 10 with a flow control device 15 is shown. The hydraulic jar 10 includes a mandrel 20 within a housing 30, with a central bore 12 within the mandrel 20. The housing 30 can be coupled to the drill pipe (not shown) near the upper end 32 of the housing 30 or other parts of the drill string. The mandrel 20 is within the housing 30, preferably in a telescoping fashion such that the mandrel 20 can move axially within the housing 30, along with the mandrel lower end 22 and mandrel upper end 23. The lower end 34 of housing 30 is preferably coupled to the remaining components of the bottom hole assembly (not shown). During normal drilling operations, drilling mud is delivered through central bore 12 to the drilling bit (not shown). A sealed, annular chamber 70, containing hydraulic fluid (timing fluid), is preferably located between the mandrel 20 and the housing 30. The flow control device 15 is preferably located within the chamber 70 and coupled to the mandrel 20, separating the chamber 70 into an upper chamber 71 and a lower chamber 72. A hammer 40 is preferably attached to the mandrel 20, between upper and lower shoulders 61, 62 of the housing 30. The flow control device 15 is shown positioned within a constriction cylinder 80 of the housing 30. The constriction cylinder 80 is maintained as part of the housing 30 between an upper housing portion 36, a lower housing portion 38, and a central housing portion 39.

The hydraulic jar 10 also includes a recocking chamber 50 disposed between the housing 30 and the mandrel 20 near the mandrel lower end 22. Preferably the recocking chamber 50 includes a recocking device 52 that applies an uphole force 6 on the mandrel 20. The recocking device 52 can comprise a mechanical structure such as a spring, a compressible fluid, a compressible gas, or a combination of any or all of these.

The housing 30 of the hydraulic jar 10 preferably includes a port 55 that provides a passage between the exterior 42 and the interior 44 of the housing 30. The port 55 preferably can permit the passage of fluid such as drilling mud.

Near the mandrel upper end 23, the hydraulic jar 10 preferably includes an opening 60 in the central bore 12 and a triggering device also referred to as a "trigger" and "trigger device") 63. The opening 60 and the triggering device 63 preferably are sized such that triggering device 63 fits into the opening 60 and substantially stops the flow of drilling fluid through the central bore 12. The triggering device 63 is preferably attachable to a tether 64, such as coiled tubing, wireline, or other means of lowering objects into a wellbore.

The hydraulic jar 10 is bidirectional, meaning it may deliver an impulse force in either an uphole direction 6 or a downhole direction 7. A load can be applied to the mandrel upper end 23 of the mandrel 20, which then moves in the downhole direction 7 relative to housing 30. A load can also be applied to the mandrel lower end 22 of the mandrel 20, which then moves in the uphole direction 6 relative to the housing 30.

Figure 2:
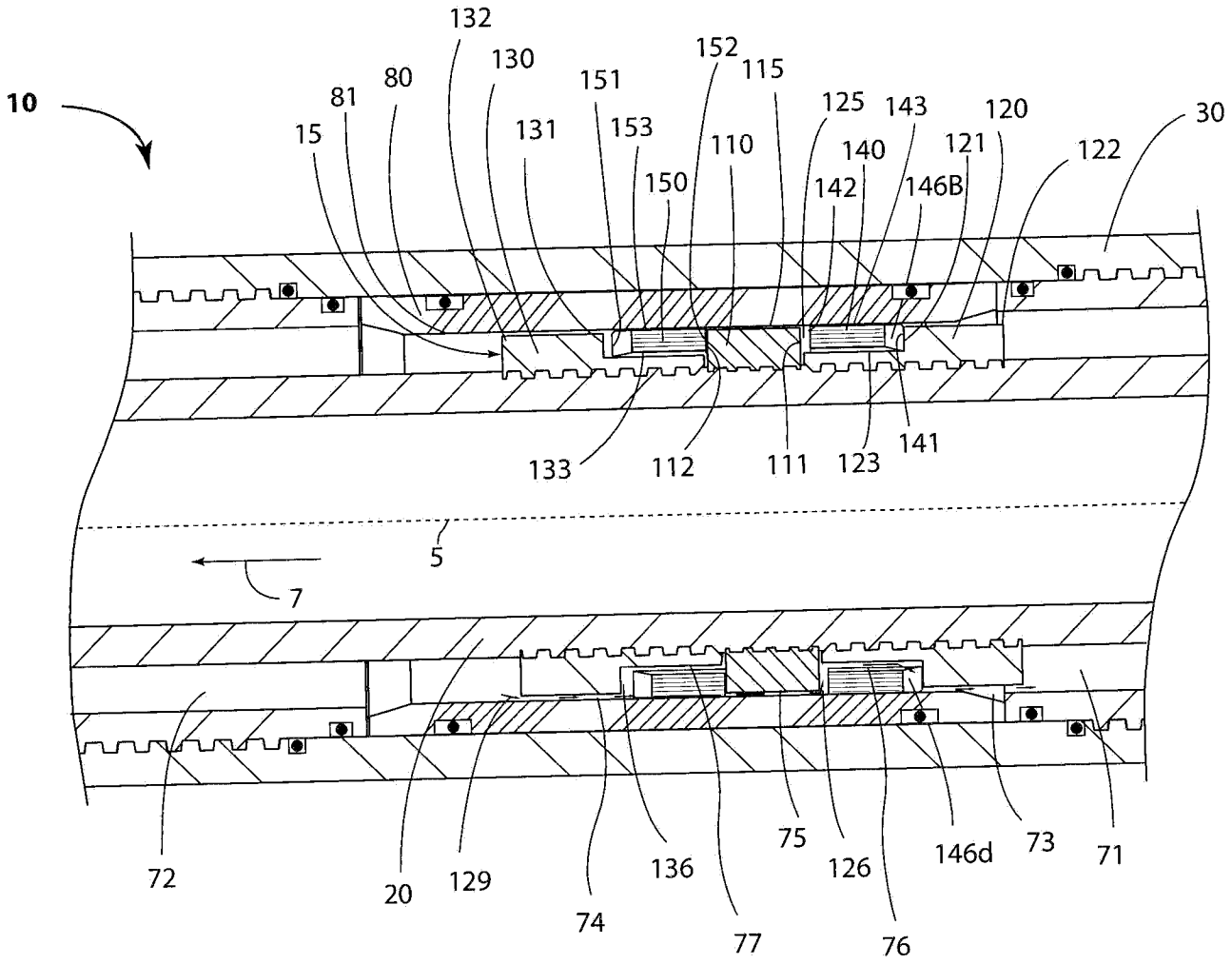
FIG. 2 shows a close-up cross-sectional view of a portion of the hydraulic jar shown in FIG. 1.

Referring now to FIG. 2, shown therein is a view of a portion of the hydraulic jar 10 in accordance with the present invention. The flow control device 15 is configured to meter hydraulic fluid moving between the upper chamber 71 and the lower chamber 72 when the mandrel 20 undergoes a force in the uphole 6 or downhole 7 direction. Specifically, the flow control device 15 obstructs, or slows down, hydraulic fluid flow between the upper chamber 71 and the lower chamber 72. Therefore, the flow control device 15 can prevent the free movement of the hammer 40 until the flow control device 15 moves out of a restrictive bore section, which is shown as a constriction cylinder 80. The constriction cylinder 80 is shown having an inner surface 81 with a narrower inside diameter in relation to the housing portions 36, 38 of the housing 30.

In order to allow movement of the mandrel 20, hydraulic fluid slowly flows between the flow control device 15 and the constriction cylinder 80, thus creating a time delay until the flow control device 15 moves past the constriction cylinder 80. At that time, the annular area, between the flow control device 15 and the housing 30, is wider and allows free movement of the mandrel 20 and the hammer 40 portions of the hydraulic jar 10 through the housing 30.

Referring still to FIG. 2, the flow control device 15 includes a stop ring 110 with a threaded attachment to the mandrel 20. The stop ring 110, which functions as a retaining ring, includes upper and lower ends defining an upper shoulder 111, a lower shoulder 112, and an outer surface 115 extending therebetween. A small centrally located gap 75 is between the outer surface 115 and the inside surface 81 of the constriction cylinder 80. As described in additional detail below, during jarring operations, the shoulders 111, 112 can function as sealing surfaces, which form a fluid seal with the upper and lower metering sleeves 140, 150. In a preferred embodiment of the flow control device 15, the shoulders 111, 112 preferably include a smooth finish that allows the shoulders 111, 112 to form a seal when contact is made with the metering sleeves 140, 150 during jarring operations. In another embodiment (not shown), the shoulders 111, 112 and/or the sleeves 140, 150 can comprise sealing elements, such as O-rings or cup seals, as an additional fluid sealing means.

The flow control device 15 is further shown in FIG. 2 comprising an upper retaining ring 120 and a lower retaining ring 130 attached by a threaded connection to the mandrel 20. The upper retaining ring 120 preferably includes a portion with a larger diameter, defining an outer surface 122, and a portion with a smaller diameter, defining an inner surface 123. The retaining rings 120, 130 along with the stop ring 110, which is also a retaining ring, form a retaining assembly that retains the metering sleeves 140, 150 in position as part of the flow control device 15. A gap 73 is between the outer surface 122 and the inside surface 81 of the constriction cylinder 80. Extending radially between the outer surface 122 and the inner surface 123 is a transition surface that defines a shoulder 121. The lower retainer ring 130 is shown having a portion with a larger diameter, defining an outer surface 132, and a portion with a smaller diameter, defining an inner surface 133. A small gap is preferably included between the outer surface 132 and the inside surface 81 of the constriction cylinder 80. A gap 74 is between the outer surface 132 and the inside surface 81 of the constriction cylinder 80. Extending radially between the outer surface 132 and the inner surface 133 is a transition surface, which defines a shoulder 131.

Although the stop ring 110 is preferably attached to the mandrel 20 by a threaded connection, the present invention is not so limited as the stop ring can be part of a unitary body with the mandrel 20 or fixed to the mandrel 20 by welding, adhesive, pins, or other common method of attachment. Similarly, the retaining rings 120, 130 may be attached to the mandrel 20 in a variety of ways against the stop ring 110. In a presently preferred embodiment, the stop ring 110 and the retaining rings 120, 130 are attached to the mandrel 20 using acme threads, but other known configurations of threaded connections to hold the components in place are equally plausible for purposes of the present invention.

Figure 3:
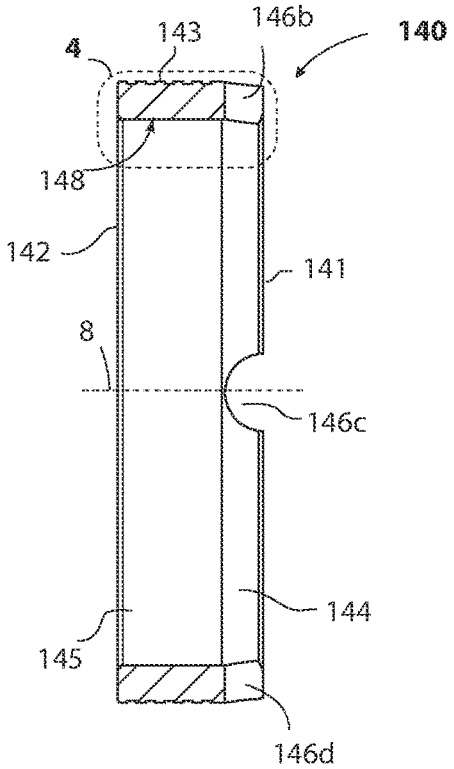
FIG. 3 shows a cross-sectional view of a portion of the hydraulic jar of FIG. 1 that includes a metering sleeve in accordance with the present invention.
Figure 4:
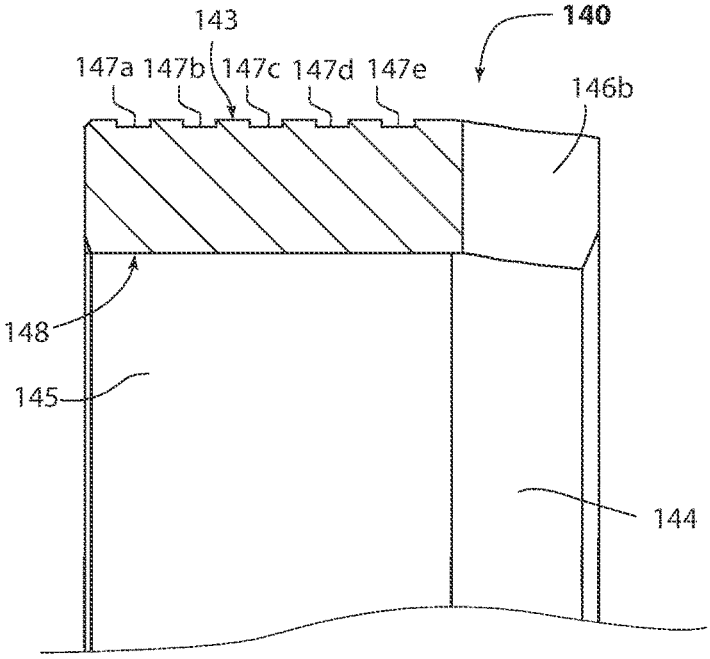
FIG. 4 shows a close-up cross-sectional view of the metering sleeve shown in FIG. 3.
Figure 5:
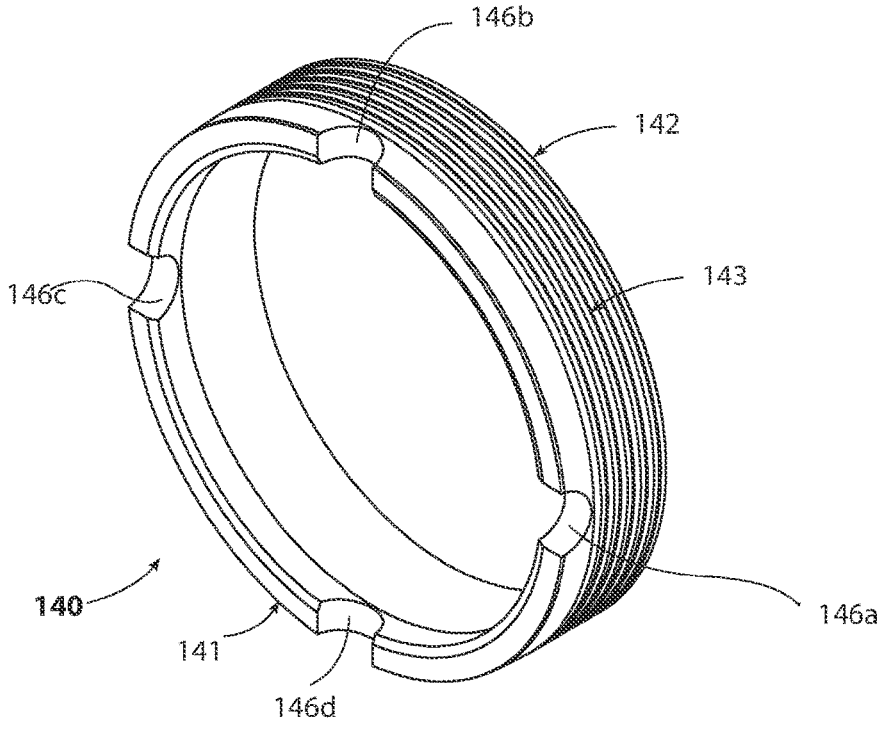
FIG. 5 shows an isometric view of the metering sleeve shown in FIG. 3.

As discussed above, FIG. 2 shows the flow control device 15 including retaining rings 120, 130 and metering sleeves 140, 150, which are ring shaped members between the housing 30 and the mandrel 20. The upper metering sleeve 140 is shown positioned about the inner surface 123 of the upper retaining ring 120 and a lower metering sleeve 150 is shown positioned about the inner surface 133 of the lower retaining ring 130. Referring now to FIGS. 3 and 4, shown therein are views of the upper metering sleeve 140, and FIG. 5, showing a view of the upper metering sleeve 140 in accordance with the present invention. The upper metering sleeve 140 is shown comprising a cylindrical portion 145, having an essentially straight throughbore defined by an essentially straight inside surface 148, and a truncated conical portion 144 having a converging (i.e., inwardly tapered) throughbore. The first end (e.g., face, edge, rim) of the upper metering sleeve 140, referred to as the sealing end 142, comprises a surface capable of forming a fluid seal against the upper shoulder 111 of the stop ring. The sealing end 142 preferably comprises a smooth finish to form a metal-to-metal fluid seal when compressed against the upper shoulder 111. In another embodiment (not shown), the sealing end 142 can comprise sealing elements, such as O-rings or cup seals, as an additional fluid sealing means. The second end (e.g., face, edge, rim) of the upper metering sleeve 140, referred to as the bypass end 141, is shown comprising four radial grooves (146*a-d*) (i.e., flow channels) extending radially through the truncated conical portion 144 of the upper metering sleeve 140. The outer surface of the upper metering sleeve 140, referred to as the metering surface 143, is shown comprising five grooves 147*a-e* (i.e., channels) extending circumferentially about the metering surface 143.

Although FIG. 5, shows the upper metering ring 140 comprising four radial grooves 146*a-c* and FIG. 4 shows five circumferential grooves 147*a-e*, the present invention is not so limited and the metering sleeve 140 can comprise any number of radial and/or circumferential grooves, which can be selected based on flow, pressure, timing delay, and other controlling operational variables. In another embodiment (not shown), the metering surface can be smooth, lacking grooves, channels, or other deformations thereon. In another embodiment (not shown) of the hydraulic jar 10, the upper and/or lower metering rings 140, 150 can have metering surfaces 143, 153 comprising other means for metering flow. For example, the metering surfaces 143, 153 can comprise grooves or channels having different widths, depths, shapes, orientations, or combinations thereof. Embodiments can also comprise grooves having diagonal or parallel orientation with respect to the central axis 8. Embodiments can also comprise grooves and/or cavities having shapes that allow for fluid metering as the fluid flows between the metering surfaces 143, 153 during jarring operations. In yet another embodiment (not shown), the inside surface 81 of the constriction cylinder 80 can be adapted for metering flow, comprising grooves or channels as described above. In yet another embodiment (not shown) of the hydraulic jar 10, the outer diameter of the sleeves 140, 150 can be slightly smaller than the diameter of the inside surface 81 of the constriction cylinder 80, for forming a small gap, therebetween, and allowing faster bleeding (e.g., fluid flow). In yet another embodiment (not shown) of the hydraulic jar 10, the upper retaining ring 120 may contain grooves, cavities, or channels therethrough or adjacent to the shoulder 142 to allow fluid flow between gap 76 and gap 73, which are described below, in conjunction to or instead of the radial grooves 146*a-d* in the upper metering sleeve.

Although the above description relating to FIGS. 3, 4, and 5 discusses the upper metering sleeve 140, the lower metering sleeve 150 depicted in FIG. 2 preferably includes the same or a substantially similar configuration as the upper metering sleeve 140. The lower metering sleeve 150 can have the same or similar parts as those of the upper metering sleeve 140, which was described above and depicted in FIGS. 3, 4, and 5. The lower metering 150 preferably functions in the same or a similar fashion as the upper metering sleeve 140.

Referring again to FIG. 2, the upper metering sleeve 140 is shown positioned about the inner surface 123 of the upper retaining ring 120. The upper metering sleeve 140 is also shown in a most up hole position on the inner surface 123. The inner diameter of the cylindrical portion 145 (see FIG. 4) of the upper metering sleeve 140 is preferably larger than the diameter of the inner surface 123 of the upper retaining ring 120, forming a gap 76 (i.e., an annular space). Because the truncated conical portion 144 (see FIG. 3) converges toward the inner surface 123, the truncated conical portion 144 can retain the upper metering sleeve 140 in an essentially central position about the upper retaining ring 120, resulting in an essentially equal gap 76 around the entire inner surface 123 of the upper retaining ring 120. As further shown in FIG. 2, the upper metering sleeve 140 is shown being retained in a longitudinal position by the shoulder 121 of the upper retaining ring 120 and the upper shoulder 111 of the stop ring 110, sliding between these two positions. The inner surface 123 of the upper retaining ring 120 is preferably axially longer than the upper metering sleeve 140, resulting in a gap 126 (i.e., an annular space) formed between the shoulder 111 and the sealing end 142 of the upper metering sleeve 140.

The upper metering sleeve 140 can slide in either the uphole direction 6 or the downhole direction 7, which allows the upper metering sleeve 140 to be positioned against the upper shoulder 111 or against the shoulder 121 of the upper retaining ring 120 (as shown in FIG. 2) to form a gap 126 between the upper metering sleeve 140 and the upper shoulder 111 of the stop ring 110. The gap 126 is shown connecting gap 76 with gap 75, allowing fluid communication therebetween.

Referring still to FIG. 2, the lower metering sleeve 150 is shown positioned about the inner surface 133 of the lower retaining ring 130. Similar to the upper metering sleeve 140, the inner diameter of the cylindrical portion of the lower metering sleeve 150 is preferably larger than the diameter of the inner surface 133 of the lower retaining ring 130, forming a gap 77 (i.e., an annular space). Because the truncated conical portion converges toward the inner surface 133, the truncated conical portion retains the lower metering sleeve 150 in an essentially central position about the lower retaining ring 130, resulting in an essentially equal gap 77 around the entire inner surface 133 of the lower retaining ring 130. As further shown in FIG. 2, the lower metering sleeve 150 is shown retained in a longitudinal position by the shoulder 131 of the lower retaining ring 130 and the lower shoulder 112 of the stop ring 110. The inner surface 133 of the lower retaining ring 130 is preferably longer than the lower metering sleeve 150, resulting in a gap 136 (i.e., an annular space) formed between the shoulder 131 and bypass end 151 of the lower metering sleeve 150. The gap 136 is shown connecting gap 74 with gap 75 and gap 76, allowing fluid communication therebetween. Similar to the upper metering sleeve 140, the lower metering sleeve 150 can preferably slide about the inner surface 133 of the lower retaining ring 130. The lower metering sleeve 150 can move in either the uphole direction 6 or the downhole direction 7.

Referring to FIG. 1 and FIG. 2, during normal drilling operations, flow control device 15 is positioned uphole 6 of the constriction cylinder 80 of the housing 30 and not in engagement with the constriction cylinder 80. When a component of the drill string (not shown) becomes stuck and it is desired to deliver an impact blow to the drill string in the downhole direction 7, a load may be applied to the hydraulic jar 10. The triggering device 6362 is dropped into the wellbore until it reaches opening 60 in mandrel 20. The drilling fluid causes the triggering device to engage the opening 60 near the mandrel upper end 23, placing a downhole 7 load on the mandrel 20.

As previously indicated in regards to FIG. 2, the constriction cylinder 80 comprises an inside surface 81 having a smaller inside diameter than the inner surface of the upper and lower chambers 71, 72. As the flow control device 15 enters the constriction cylinder 80, a fluid restriction is formed between the inside surface 81 and the metering surfaces 143, 153 of the flow control device 15. Thus, when aligned with the constriction cylinder 80, the metering sleeves 140, 150 of the flow control device 15 engage the inside surface 81 of the constriction cylinder 80, resulting in flow restriction or metering action, as the hydraulic fluid flows between the upper portion 71 and the lower portion 72 of the annular chamber 70.

When the drill string becomes stuck and an impact blow to the drill string in the downhole direction 7 is desired, a load may be applied to the hydraulic jar 15 from above.

Referring again to FIGS. 1 and 2, a load is applied to the mandrel upper end 23 of the mandrel 20 by placing the triggering device 63 in the wellbore until it reaches opening 60 in the mandrel 20. The mandrel 20 will move axially downhole 7 within the housing 30, bringing the fluid control device 15 within the constriction cylinder 80. As a result of the alignment of the flow control device 15 with the constriction cylinder 80, fluid pressure in lower chamber 72 begins to increase. In turn, the increase in fluid pressure in the lower chamber 72, and/or the friction between the metering surfaces 143, 153 and the inside surface 81 of the constriction cylinder 80, causes the upper and the lower metering sleeves 140, 150 to contact the upper retaining ring 120 and the stop ring 110, respectively. The bypass end 141 of the upper metering sleeve 140 contacts the shoulder 121 of the upper retaining ring 120 and the sealing end 152 of the lower metering sleeve 150 contacts the lower shoulder 112 of the stop ring 110.

Hydraulic fluid then begins to flow through the flow control device 15. Specifically, as indicated by the arrows 129, the hydraulic fluid flows from the lower chamber 72 into gap 74 and gap 136. Thereafter, the hydraulic fluid flows between the metering surface 153 of the lower metering sleeve 150 and the inside surface 81 of the constriction cylinder, thus metering (e.g., restricting, reducing) hydraulic fluid flow by the reduced flow area therebetween. The hydraulic fluid cannot bypass the lower metering sleeve 150 through gap 77, as the sealing end 152 is forced against the lower shoulder 112 to form a seal therebetween.

Once the hydraulic fluid passes the lower metering sleeve 150, the fluid enters the gap 75 and continues to flow through the gap 126 into the gap 76. Thereafter, the hydraulic fluid flows through the radial grooves 146*a-d* (146*a* and 146*c* shown in FIG. 3), bypassing the upper metering sleeve 140, and continues into the gap 73 and the upper chamber 71. Thus, hydraulic fluid is metered as it passes from the lower chamber 72 to the upper chamber 71, slowing down the movement of the mandrel 20 within the housing 30.

When a predetermined time delay is reached, and a load that is determined to be appropriate to deliver an impact to free the stuck tool, the hydraulic jar 10 fires. As mandrel 20 continues to move slowly in the downhole direction 7, the drill string (not shown) compresses elastically and stores mechanical energy therein. When the flow control device 15 exits the constriction cylinder 80, the flow path between the lower chamber 72 and the upper chamber 71 becomes wider because the fluid flow is no longer metered by the lower metering sleeve 150, allowing hydraulic fluid to pass into the upper chamber 71 at a higher flow rate. The mandrel 20 accelerates and thus, the hammer 40, in the downhole direction 7, until the hammer 40 impacts the lower shoulder 62 of the housing 30 to create an impact to free the stuck tool. During this process, the mandrel upper end 23 moves downhole 7 of the port 55, allowing the drilling fluid to exit into the well outside of the housing 30. Pumping is stopped at the surface and the load on the mandrel 20 is significantly decreased. The recocking device 52 then moves the mandrel 20 in the uphole direction 6, thereby resetting the hydraulic jar 10 for another impact force. In an alternate preferred embodiment, the recocking device 52 imparts an uphole 6 load on the mandrel 20, acting in reverse of the downhole 7 action described above, causing the hammer 40 to impact the upper shoulder 61 to free the stuck tool.

As described above, the flow control device 15 can be bidirectional, providing hydraulic fluid metering when the hydraulic jar 10 is actuated in either an uphole 6 or downhole 7 directed load. It should be understood that the manner in which the flow control device 15 meters fluid when the hydraulic jar 10 is loaded in the downhole 7 direction can be similar or the same to the manner in which the flow control device 15 meters fluid when the hydraulic jar 10 is loaded in the uphole 6 direction.

It should also be understood that in another embodiment (not shown) of the hydraulic jar 10, the flow control device 15 can be constructed or reconfigured to be uni-directional, acting to provide fluid metering when the hydraulic jar 10 is under load from the uphole 6 direction only. To reconfigure the flow control device 15 to provide fluid metering only when hydraulic jar 10 is in loaded from the uphole 6 direction, the upper metering sleeve 140 can be configured in the opposite direction about the inner surface 123 of the upper retaining ring 140, wherein the bypass end 141 is positioned downhole 7 relative to the sealing end 142. In another embodiment (not shown) of the hydraulic jar 10, the lower metering sleeve 150 and the lower retaining ring 130 can be decoupled from the mandrel 20 and removed from the flow control device 15. The above configurations will allow fluid metering as the mandrel 20 is moving in the downhole direction 7 while allowing the fluid to bypass the metering sleeves 140, 150 as the mandrel 20 moves in the uphole direction 6 relative to the housing 20.

Similarly, in another embodiment (not shown) of the hydraulic jar 10, to reconfigure the flow control device 15 to provide fluid metering only when hydraulic jar 10 is loaded from the uphole direction 6, the upper metering sleeve 140 can be configured in the opposite direction about the inner surface 123 of the upper retaining ring 120, wherein the bypass end 141 is positioned downhole 7 relative to the sealing end 142. In yet another embodiment (not shown) of the hydraulic jar 10, the upper metering sleeve 140 and the upper retaining ring 120 can be decoupled from the mandrel 20 and removed from the flow control device 15. These configurations will allow fluid metering as the mandrel 20 is moving in the downhole direction 7 while allowing the fluid to bypass the metering sleeves 140, 150, as the mandrel 20 is moving in the uphole direction 6 relative to the housing 20.

While various embodiments usable within the scope of the present disclosure have been described, it should be understood that within the scope of the appended claims, the present invention can be practiced other than as specifically described. It should be understood by persons of ordinary skill in the art that an embodiment of the hydraulic jar in accordance with the present disclosure can comprise all of the features described above. It should also be understood that each feature described above can be incorporated into the hydraulic jar by itself or in combinations, without departing from the scope of the present disclosure.

I claim:

1. A hydraulic jar for creating an impulse force in a downhole string in a wellbore, comprising:

a tubular housing having an interior and an exterior, wherein the housing includes a passage from the interior to the exterior;

a mandrel axially movable within the housing forming an annular space between the mandrel and the housing that includes a timing fluid, the mandrel including a central bore that permits the flow of a drilling fluid;

a timing device fixed to the mandrel in the annular space;

a trigger capable of blocking the flow of drilling fluid through the central bore in the mandrel, wherein the mandrel moves axially in the housing when the trigger engages the mandrel, and wherein the timing device causes the mandrel to move at a first speed and at a second speed to create the impulse, wherein drilling fluid exits the interior through the passage after the mandrel moves past the passage; and a recocking device that moves the mandrel toward the passage, wherein the recocking device includes a spring.

2. The hydraulic jar of claim 1, wherein the trigger is attached to a tether that extends into the wellbore.

3. The hydraulic jar of claim 1, wherein the recocking device provides an impulse force.

4. The hydraulic jar of claim 1, wherein the central bore of the mandrel includes a tapered end that receives the trigger.

5. The hydraulic jar of claim 1, wherein the trigger has a first diameter that fits into the central bore and a second diameter that is larger than the central bore.

6. The hydraulic jar of claim 2, further comprising an anvil, wherein the recocking device moves the mandrel toward the passage and causes the mandrel to impact the anvil.

7. A hydraulic jar comprising:

a tubular housing having in interior, an exterior, an anvil, and a passage that extends from the interior to the exterior;

a tubular mandrel in the interior of the tubular housing having an exterior, a central bore, a hammer, and a timing device affixed to the exterior of the mandrel, wherein the tubular mandrel is movable in an axial direction in the housing and wherein drilling fluid flows through the central bore;

a triggering device attached to a tether, wherein the triggering device impedes the flow of the drilling fluid through the axial opening, wherein the timing device causes the mandrel to move at a first speed and a second speed, and wherein the hammer impacts the anvil;

wherein the drilling fluid exits the housing through the passage in the housing after the hammer impacts the anvil;

a recocking device between the mandrel and the housing; and a second anvil in the housing, wherein the recocking device moves the mandrel toward the passage and provides an impulse force on the second anvil.

8. The hydraulic jar of claim 7, further comprising a recocking device between the mandrel and the housing that imparts a force on the mandrel that moves the mandrel toward the passage after the fluid exits the housing.

9. The hydraulic jar of claim 7, wherein the central bore of the mandrel includes a tapered end that receives the triggering device.

10. The hydraulic jar of claim 7, wherein the triggering device has a first diameter that fits into the central bore and a second diameter that is larger than the central bore.

11. The hydraulic jar of claim 7 wherein the recocking device includes a spring.

12. A hydraulic jar comprising:

a tubular housing having an exterior, a hollow interior, and a passage from the hollow interior to the exterior;

a tubular mandrel in the hollow interior that forms a timing chamber and a recocking chamber between the mandrel and the housing, the mandrel having a central bore for the flow of drilling fluid;

a timing device in the timing chamber and affixed to the mandrel between the mandrel and the housing;

a recocking device in the recocking chamber that imparts a force on the mandrel toward the passage in the housing;

a triggering device that impedes the flow of drilling fluid into the central bore;

a tether attached to the triggering device;

wherein the timing device causes the mandrel to move at a first speed and a second speed;

wherein drilling fluid exits the passage to the exterior of the housing after the mandrel moves at the second speed; and wherein the recocking device moves the mandrel toward the triggering device.

13. The hydraulic jar of claim 12, wherein the central bore of the mandrel includes a tapered end that receives the triggering device.

14. The hydraulic jar of claim 12, wherein the triggering device has a first diameter that fits into the central bore and a second diameter that is larger than the central bore.

15. The hydraulic jar of claim 12, further comprising an anvil, wherein the recocking device moves the mandrel toward the passage and causes the mandrel to impact the anvil.

16. The hydraulic jar of claim 12 wherein the recocking device includes a spring.

* * * * *